US006067721A

United States Patent [19]

Dall'Aglio et al.

[11] Patent Number: 6,067,721

[45] Date of Patent: May 30, 2000

[54] APPARATUS FOR CHECKING THE DIAMETER OF CRANKPINS ROTATING WITH AN ORBITAL MOTION

[75] Inventors: Carlo Dall'Aglio, Castello D'Argile; Riccardo Cipriani, Ferrara, both of Italy

[73] Assignee: Marposs Societa' per Azioni, Bentivoglio, Italy

[21] Appl. No.: 09/011,928

[22] PCT Filed: Sep. 23, 1996

[86] PCT No.: PCT/EP96/04147

§ 371 Date: Feb. 24, 1998

§ 102(e) Date: Feb. 24, 1998

[87] PCT Pub. No.: WO97/12724

PCT Pub. Date: Apr. 10, 1997

[30] Foreign Application Priority Data

Oct. 3, 1995 [IT] Italy ..... BO95A0469

[51] Int. Cl.[7] ..... G01B 3/00; G01D 21/00

[52] U.S. Cl. ..... 33/555.1; 33/655

[58] Field of Search ..... 33/655, 657, 660, 33/555.1, 555.3

[56] References Cited

U.S. PATENT DOCUMENTS

| | | | |
|---|---|---|---|
| 1,941,456 | 1/1934 | Arnold | 33/555.1 |
| 3,386,178 | 6/1968 | Arnold et al. | 33/555.1 |
| 4,351,115 | 9/1982 | Possati | 33/555.1 |
| 4,637,144 | 1/1987 | Schemel | 33/555.1 |
| 5,761,821 | 6/1998 | Laycock | 33/555.1 |

FOREIGN PATENT DOCUMENTS

| | | |
|---|---|---|
| 756177 | 12/1933 | France . |
| 1362996 | 8/1974 | United Kingdom . |

*Primary Examiner*—Randy W. Gibson

*Attorney, Agent, or Firm*—Dickstein Shapiro Morin & Oshinsky LLP

[57] ABSTRACT

An apparatus for checking the diameter of crankpins (18) of a crankshaft (34) in the course of the machining in a grinding machine comprises a first arm (9) rotating with respect to a support (5) arranged on the grinding-wheel slide (1) of the grinding machine, a second arm (12) rotating with respect to the first, a reference device (20) carried by the second arm and a measuring device (16, 17, 40–45) associated with a reference device. A guide device (21), fixed to the reference device (20), enables the apparatus to engage a crankpin, in the course of the orbital motion of the crankpin, and limit the displacements of the first arm and those of the second arm when a control device (28–30) displaces the apparatus to a rest position.

36 Claims, 7 Drawing Sheets

APPARATUS FOR CHECKING THE DIAMETER OF CRANKPINS ROTATING WITH AN ORBITAL MOTION

TECHNICAL FIELD

The present invention relates to an apparatus for checking the diameter of crankpins rotating with an orbital motion about a geometrical axis, in the course of the machining in a numerical control grinding machine including a worktable, defining said geometrical axis, and a grinding-wheel slide with a reference device for cooperating with the crankpin to be checked, a measuring device, movable with the reference device, and a support device for supporting the reference device and the measuring device, the support device having a support element, a first coupling element coupled to the support element so as to rotate about a first axis of rotation parallel to said geometrical axis, and a second coupling element carrying the reference device and coupled, in a movable way, to the first coupling element.

BACKGROUND ART

U.S. Pat. No. 4,637,144, to which the first part of claim 1 refers, discloses an apparatus for checking the diameter of crankpins orbiting about a geometrical axis, in the course of the machining in a grinding machine. The apparatus is supported by a support fixed to the worktable of the grinding machine, or by a support affixed to the bed of the grinding machine, or by a longitudinal slide arranged on the worktable.

The apparatus comprises a reference device, Vee-shaped or of another type, for cooperating with the crankpin to be checked, a measuring head fixed to the reference device and provided with two movable arms carrying feelers for contacting diametrically opposite points of the crankpin, a cylinder and piston device, and a coupling device between the cylinder and the support of the apparatus. The reference device is supported by the piston rod and thus is movable along the geometric axis of the cylinder. Moreover, the reference device can rotate, with the cylinder, about an axis of rotation defined by the coupling device and parallel to the geometric axis whereabout the crankpin rotates. The cylinder and piston device comprises a spring, that acts on the piston so as to urge the reference device towards the crankpin to be checked, and a hydraulic or pneumatically actuated device for displacing the piston towards a rest position, in opposition to the force of the spring. In the course of the checking operation, the apparatus is located, with respect to the workpiece, substantially at the opposite side with respect to the one where the grinding wheel is located.

The apparatus and its applications in a grinding machine, described in the formerly mentioned patent, are subject to some inconveniences like considerable layout dimensions, in particular in a transversal direction, high forces of inertia, the impossibility of displacing in an automatic way the reference device from the rest position to the measuring position while the piece (crankshaft) is rotating. These inconveniences are due to both the structure of the apparatus and its application in the machine. All the applications described in the patent involve, in the course of the measurement taking, that the reference device describes a trajectory basically corresponding to the orbital motion of the crankpin.

U.S. Pat. No. 4,351,115 discloses a machine for the dimensional checking of a crankshaft, comprising devices for checking the crankpins in the course of their orbital motion about the main geometrical axis of the crankshaft. Each of these checking devices comprises a guide and reference device, supported by the machine frame, by means of two arms, rotating reciprocally and with respect to the frame, about two axes of rotation parallel to the geometrical axis of the orbital motion. This machine and its associated checking devices are not suitable for checking during the machining operation, among other things owing to the fact that the guide and reference devices describe trajectories that essentially correspond to the orbital motion of the associated crankpin, the speed of the orbital motion is considerably lower with respect to that occurring in the course of the machining in a crankpin grinding machine and the displacement of the checking devices from a rest position to an operating condition occurs when the crankshaft is not rotating.

U.S. Pat. No. 3,386,178 discloses an apparatus, for checking the diameter of cylindrical workpieces, rotating about their geometrical axis, in the course of the machining in a grinding machine. The apparatus comprises two arms, rotating reciprocally and with respect to the grinding-wheel slide. One of the arms supports two reference elements or fixed (with respect to the arm) feelers for contacting the surface of the rotating workpiece and a movable stem, with a feeler for contacting the workpiece and an opposite end for cooperating with the movable element of a clock comparator. The apparatus is manually displaced from a rest position to a measuring condition, and vice versa. The grinding machine cannot machine workpieces rotating with an orbital motion, nor is the measuring apparatus suitable for a similar type of application.

DISCLOSURE OF THE INVENTION

Object of the present invention is to provide an apparatus for the metrological checking of crankpins rotating with an orbital motion, in the course of a grinding operation, or in a similar one, that can provide good metrological performance, high reliability and small forces of inertia. This problem is solved by a measuring apparatus of the hereinbefore mentioned type, wherein the second coupling element is coupled to the first coupling element in such a way as to rotate with respect to it about a second axis of rotation parallel to said geometrical axis, the support element is fixed to the grinding-wheel slide and there are foreseen a guide device, associated with the reference device, for guiding the arrangement of the reference device on the crankpin in the course of the orbital motion and a control device for enabling the apparatus to displace in an automatic way from a rest position to a checking condition, and vice versa.

Preferably, in the rest position, the reference device is arranged substantially above those positions that, in the grinding machine, are assumed by the geometrical axis of the crankpin to be checked and in the course of the displacement towards the operating condition it enters into engagement with the crankpin, guided by the guide device, describing a trajectory with a prevailing vertical component.

Preferably, the reference device is substantially a Vee-shaped device.

Preferably, the guide device defines a shaped guiding surface that is aligned with a surface of the reference device.

According to another characteristic, the control device can be advantageously achieved by means of a double-acting cylinder, for example of the hydraulic type.

According to a further characteristic, the apparatus is made so that, in the operating condition, the reference device rests on the crankpin substantially owing to the forces of gravity, the values of which are appropriately predetermined by a suitable arrangement and entity of the weights of the component parts.

Still further aspects of the invention regard, among other things, manufacturing features for enabling the checking of the diameter of the crankpins while avoiding any interferences with the lubrication holes present in the crankpins and for checking crankshafts with even considerably different nominal dimensions, and safety devices for preventing any collisions or unwanted and/or dangerous motions.

The characteristics of the apparatus and of its application in the grinding machine enable to combine remarkable functionality with relatively low costs and to obtain an arrangement of the apparatus that facilitates the loading and the unloading of the crankshafts and limits the layout dimensions in the areas surrounding the more critical elements of the grinding machine and the accessory devices, like the workpiece loading/unloading devices.

BRIEF DESCRIPTION OF THE DRAWINGS

The invention is now described in more detail with reference to the enclosed drawings, showing a preferred embodiment by way of illustration and not of limitation. In said drawings.

BEST MODE FOR CARRYING OUT THE INVENTION

Figure 1:
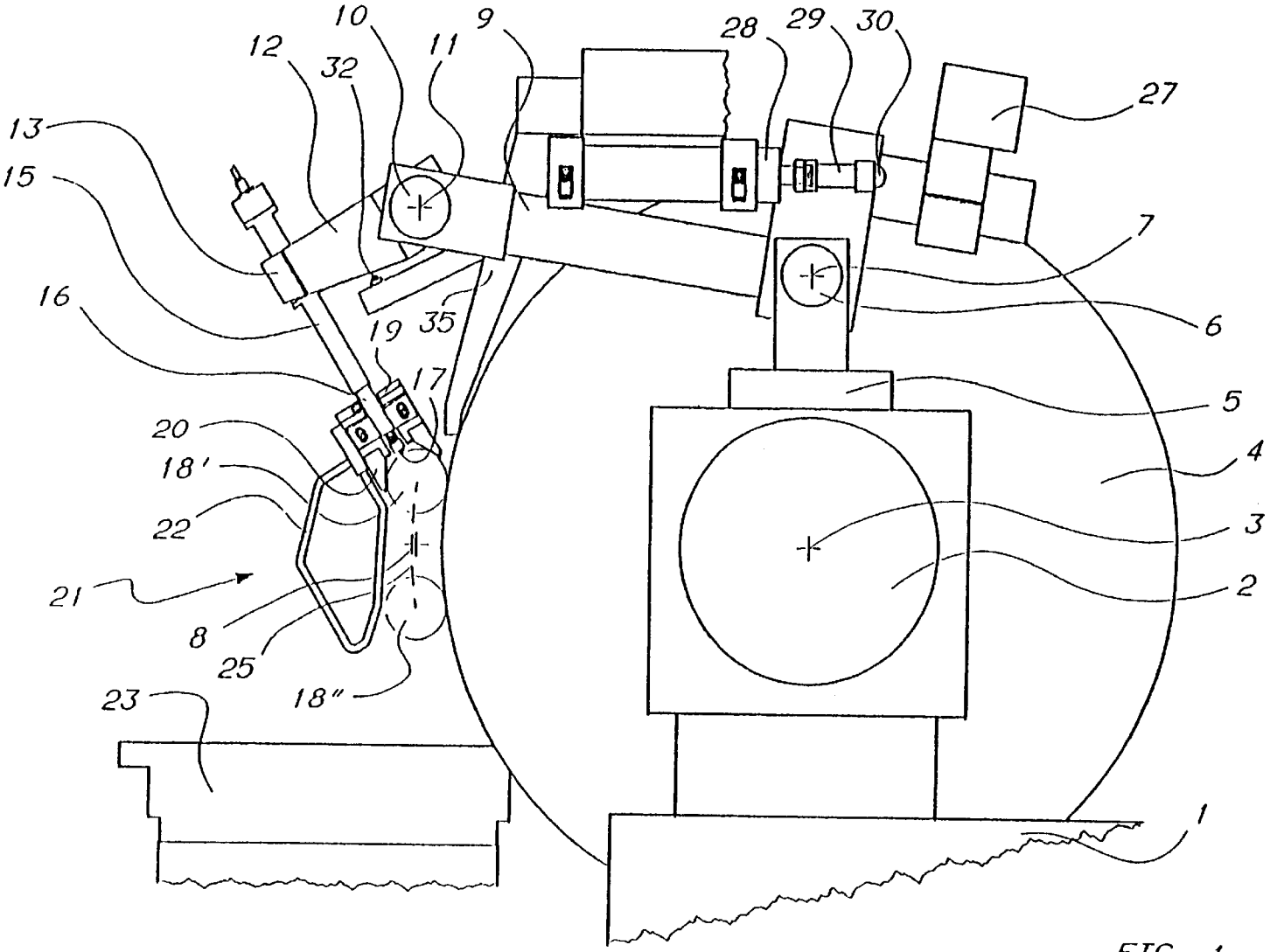
FIG. 1 is a lateral view of a measuring apparatus mounted on the grinding-wheel slide of a grinding machine for crankshafts, in the highest position that the apparatus reaches during the grinding of a crankpin rotating with an orbital motion about the main axis of the crankshaft.

With reference to FIG. 1, the grinding-wheel slide 1 of a computer numerical control ("CNC") grinding machine for grinding crankshafts supports a spindle 2 that defines the axis of rotation 3 of grinding wheel 4. Above spindle 2 the grinding-wheel slide 1 carries a support device including a support element 5 that, by means of a rotation pin 6, with preloaded bearings—not shown—, defining a first axis of rotation 7 parallel to the axis of rotation 3 of grinding wheel 4 and to the axis of rotation 8 of the crankshaft, supports a first rotating, coupling, element 9. The axis of rotation 7 substantially lies in a vertical plane wherein the axis of rotation 3 of grinding wheel 4 lies, above the axis of rotation 3 of grinding wheel 4 and below the upper periphery of the grinding wheel. In turn, coupling element 9, by means of a rotation pin 10, with preloaded bearings—not shown—, defining a second axis of rotation 11 parallel to the axis of rotation 3 of grinding wheel 4 and to the axis of rotation 8 of the crankshaft, supports a second rotating, coupling element 12. At the free end of the coupling element 12 there is coupled, fixedly or—as shown in the figures—in an adjustable way, by means of a tie coupling 13 with an associated locking/unlocking knob, a tubular guide casing 15 wherein there can axially translate a transmission rod 16 carrying a feeler 17 for contacting the surface of the crankpin 18 to be checked. The displacements of rod 16 are detected by a measuring device, as hereinafter disclosed. At the lower end of the tubular guide casing 15 there is fixed a support block 19 supporting a reference device 20, Vee-shaped, adapted for engaging the surface of the crankpin 18 to be checked, by virtue of the rotations allowed by pins 6 and 10. The transmission rod 16 is movable along the bisecting line of the Vee-shaped reference device 20.

The support block 19 further supports a guide device 21, that, according to the following more detailed description, serves to guide the reference device 20 to engage crankpin 18 and maintain contact with the crankpin while the reference device 20 moves away from the crankpin, for limiting the rotation of the first 9 and of the second 12 coupling elements about the axes of rotation 7, 11 defined by pins 6 and 10. The guide device 21 consists of a metal rod 22 suitably bent in order to have a guide portion that can cooperate with crankpin 18.

Figure 2:
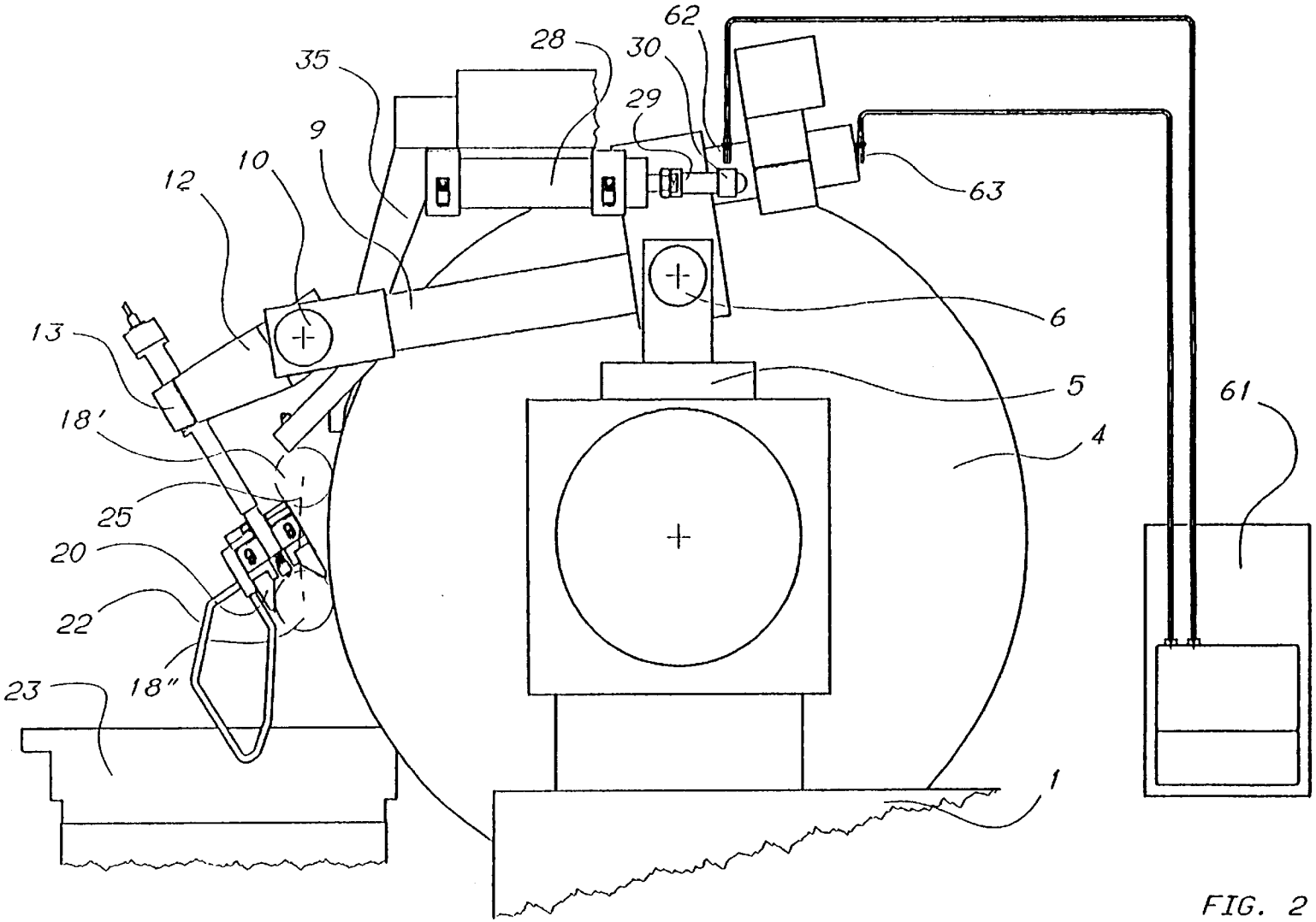
FIG. 2 is a similar view as that of FIG. 1, wherein the apparatus is in the lowest possible position it reaches in the course of the grinding of the crankpin.

The crankshaft to be checked is positioned on the worktable 23, between a spindle and a tailstock, not shown, that define the axis of rotation 8, coincident with the main geometrical axis of the crankshaft. As a consequence, crankpin 18 performs an orbital motion about axis 8. Reference number 18' indicates the upper position that the crankpin reaches, whereas reference number 18" indicates the crankpin lower position. FIGS. 1 and 2 show the positions of the measuring apparatus when the crankpin reaches the upper position 18' and the lower one 18", respectively. Even though crankpin 18 rotates eccentrically about axis 8, by describing a circular trajectory, the trajectory of the pin with respect to the grinding-wheel slide 1 can be represented, substantially, by an arc shown with a dashed line and indicated by reference number 25. Thus, reference device 20 describes a similar trajectory, with a reciprocating motion from up to down and vice versa and at a frequency—of some tens of revolutions per minute—equal to that of the orbital motion of crankpin 18. This is due to the fact that the checking apparatus is carried by the grinding-wheel slide 1 that, in modern numerical control grinding machines, machines the crankpins, while they rotate in an orbital motion, by "tracking" the pins so as to keep the grinding wheel in contact with the surface to be ground. Obviously, there is added, to the transversal "tracking" motion, a feed motion for the stock removal. Thus, it is understood that the displacements of the elements forming the checking apparatus involve relatively small forces of inertia, to the advantage of the metrological performance, limited wear and reliability of the apparatus.

Figure 3:
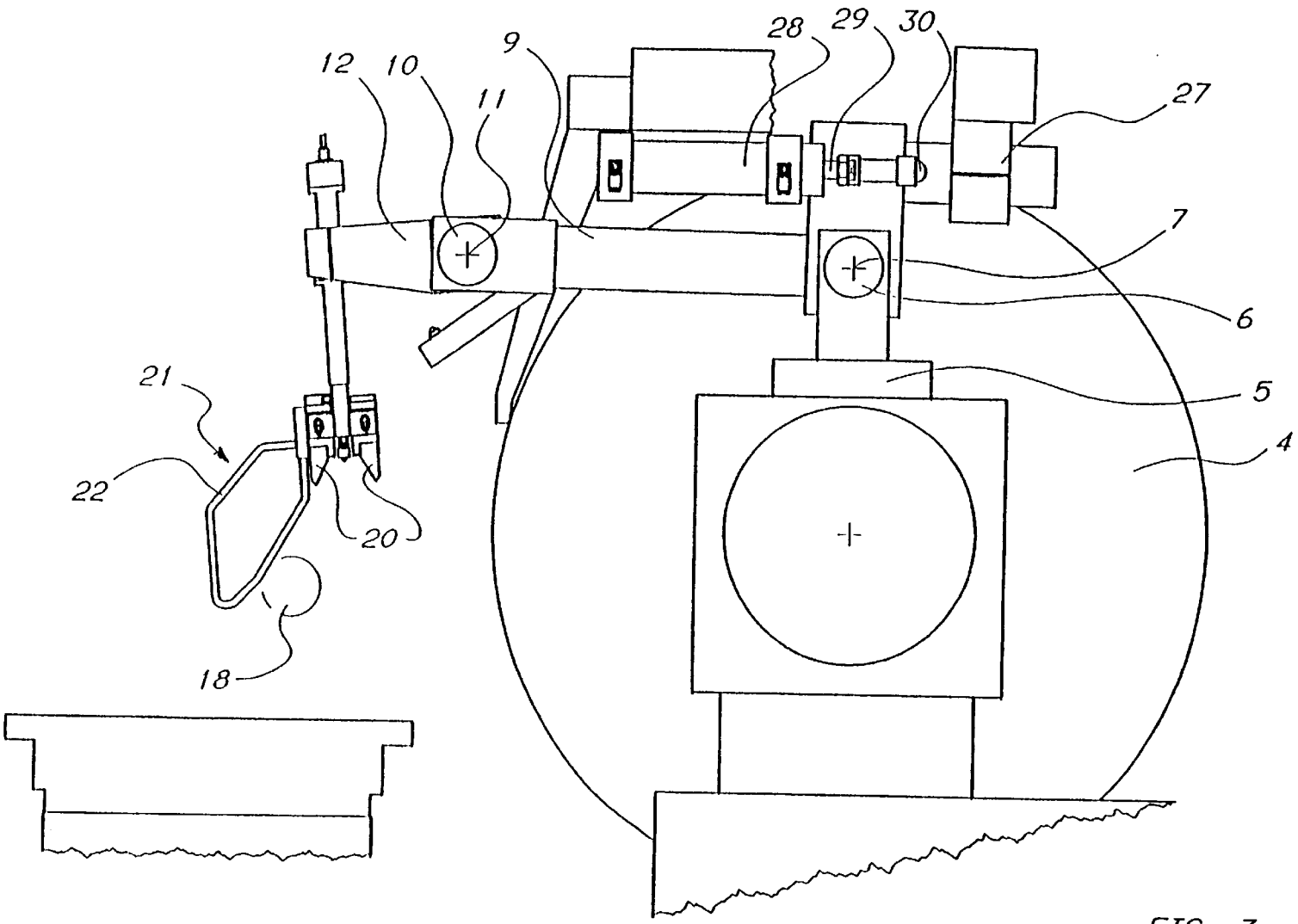
FIG. 3 is a lateral view of the apparatus shown in FIGS. 1 and 2 under a condition whereby the grinding machine numerical control has commanded a withdrawal of the grinding wheel for emergency reasons.
Figure 4:
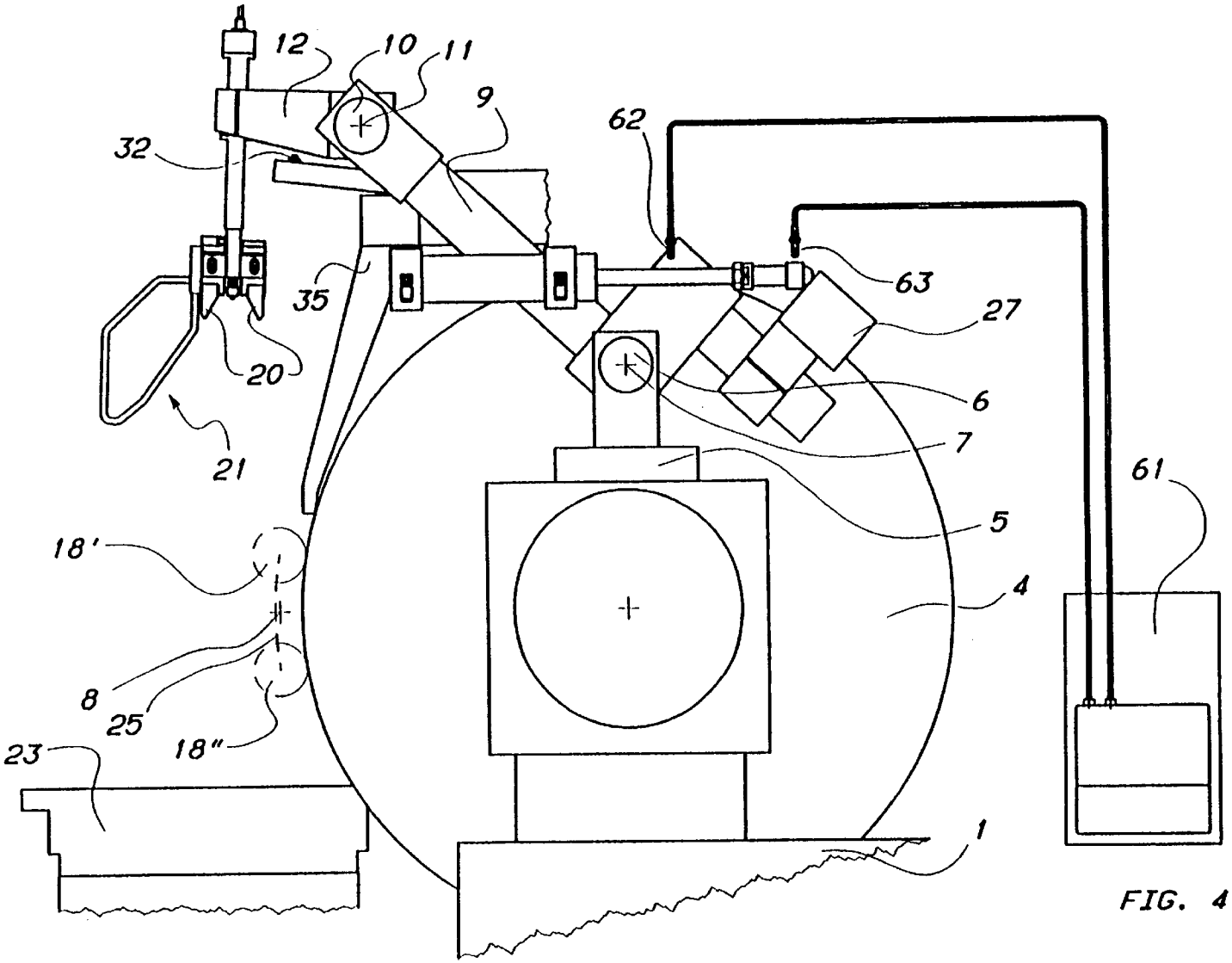
FIG. 4 is a lateral view showing the apparatus of FIGS. 1–3 in the rest position.

As known, modern grinding machines are equipped with a plurality of sensors for detecting various parameters and information, on the ground of which the numerical control of the machine suitably operates. In the event of an emergency, the numerical control can control the grinding wheel to immediately withdraw from the workpiece. FIG. 3 shows the position of the checking apparatus further to the withdrawal of the grinding-wheel slide 1 for emergency reasons. It is understood that in the course of the emergency withdrawal reference device 20 disengages from crankpin 18 and the latter enters into contact with the guide device 21, remaining in contact with it even at the end of the withdrawal of grinding-wheel slide 1. In this way the rotations of the coupling elements 9 and 12 about the axes of rotation 7 and 11 are limited and the checking apparatus is prevented from undertaking dangerous positions.

The checking apparatus shown in FIGS. 1 to 5 comprises a counterweight 27, coupled to element 9, in such a way that it is prevalently arranged at the opposite side of the latter with respect to pin 6, and a control device comprising a double-acting cylinder 28, for example of the hydraulic type. Cylinder 28 is supported by grinding-wheel slide 1 and comprises a rod 29, coupled to the piston of the cylinder, carrying at the free end a cap 30. When cylinder 28 is activated for displacing the piston and the rod 29 towards the right (with reference to FIG. 1), cap 30 contacts an abutment fixed to counterweight 27 and causes the displacement of the checking apparatus in the rest position shown in FIG. 4, according to which reference device 20 is arranged above the geometrical axis 8 and the crankpin upper position 18', with the bisecting line of the Vee substantially arranged in vertical direction. During this displacement, an abutting surface, fixed to the coupling element 12, enters into contact with a positive stop element 32, fixed to the coupling element 9, thus defining a minimum value of the angle formed between the two coupling elements 9 and 12, for the purpose of both preventing interferences with devices of the grinding machine and defining a rest position for enabling the displacing of the apparatus to the checking position to occur in the best possible way. The retraction of the checking apparatus to the rest position is normally controlled by the grinding machine numerical control when, on the ground of the measuring signal of the checking apparatus, it is detected that crankpin 18 has reached the required (diametral) dimension. Thereafter, the machining of other parts of the crankshaft takes place, or—in the event the machining of the crankshaft has been completed—the piece is unloaded, manually or automatically, and a new piece is loaded on worktable 23.

When a new crankpin has to be machined, it is brought in front of grinding wheel 4, usually by displacing the worktable 23 (in the event of a grinding machine with a single grinding wheel), and the checking apparatus moves to the measuring position. This occurs by controlling, by means of the grinding machine numerical control, cylinder 28 so that rod 29 is retracted. Thus, cap 30 disengages from the abutment of counterweight 27 and, through rotation of the coupling elements 9, 12, at first only about the axis of rotation 6 and thereafter also about the axis of rotation 11, due to the specific weight of the components of the checking apparatus, support block 19 approaches, by describing a trajectory with a mainly vertical component, crankpin 18, that in the meanwhile moves according to its orbital trajectory. Depending on the instantaneous position of the crankpin 18, the initial contact can occur by means of the guide device 21 or directly by means of the reference device 20. In any case, the correct cooperation between crankpin 18 and reference device 20 is rapidly achieved. This cooperation is maintained in the course of the checking phase by virtue of the displacements of the coupling elements 9, 12, caused by the force of gravity and by the thrust of crankpin 18, in opposition to the force of gravity of the elements of the checking apparatus. The structure of the apparatus is such that each of the sides of the Vee of the reference device 20 applies to crankpin 18 a force, due to gravity, of about one kilogram.

Figure 5:
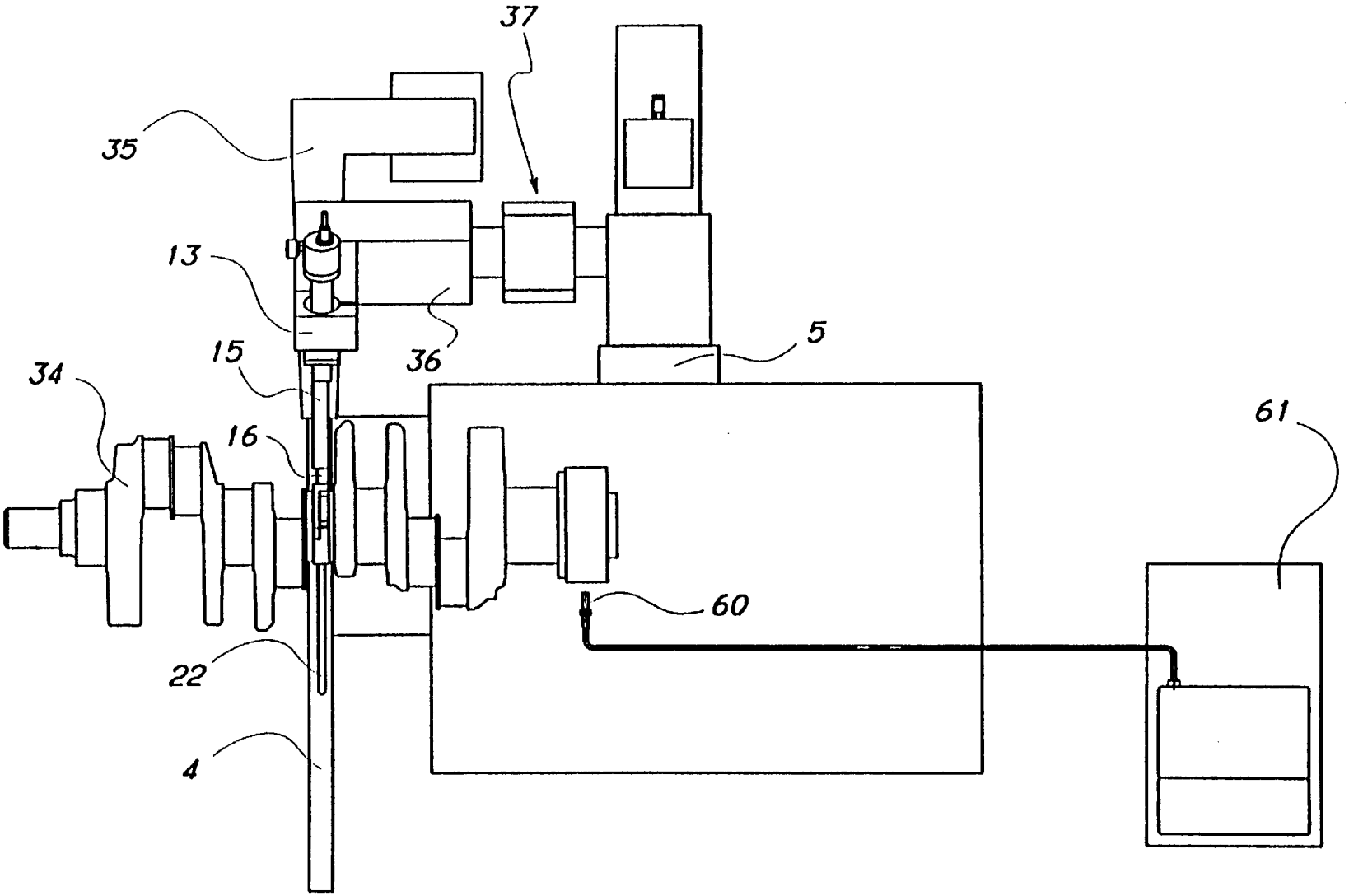
FIG. 5 is a partial front view of the apparatus mounted on the grinding-wheel slide of the grinding machine.

In some cases, the retraction of the rod 29 may be controlled so that the approaching movement of the support block 19 be temporarily stopped in correspondence of a position close to the trajectory 25, but slightly apart from the upper position 18' of the crankpin 18. The full retraction of rod 29 is then controlled by the numerical control when the crankpin 18 is going to reach its upper position 18' so that the crankpin 18 dynamically engages the guide device 21 substantially in correspondence of such upper position 18'. This proceeding allows to have a very low mutual speed between the parts that come into engagement with each other (the guide device 21 and the crankpin 18), so providing a very soft impact between them. The coupling elements 9 and 12 are basically linear arms with geometric axes lying in transversal planes with respect to the axis of rotation 8 of the crankshaft and to the axis of rotation 3 of grinding wheel 4. However, as shown in FIG. 5, wherein there is also shown a crankshaft 34, in order to avoid any interferences with elements and devices of the grinding machine, in particular with tube 35, not shown in FIG. 5, that directs, by means of a nozzle, coolant towards the surface being machined, the coupling elements 9 and 12 comprise portions 36 and 37 extending in a longitudinal direction and portions offset in different transversal planes.

Figure 6:
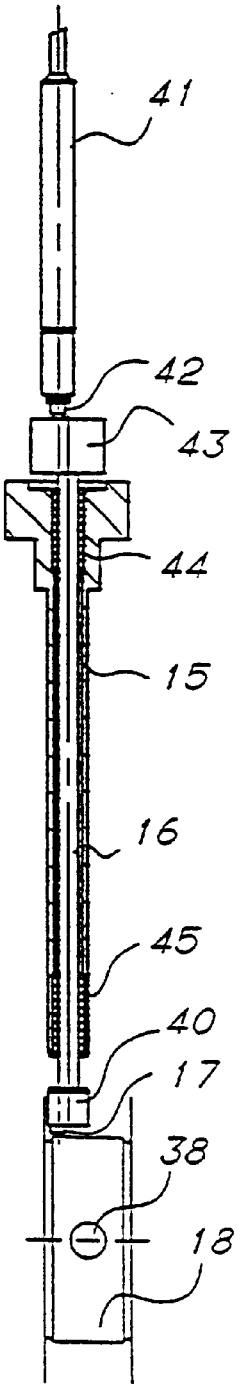
FIG. 6 shows a detail of the measuring device of the apparatus for the comparative measurement of the diameter of a crankpin so as to avoid interferences with the lubrication hole in the crankpin.
Figure 7:
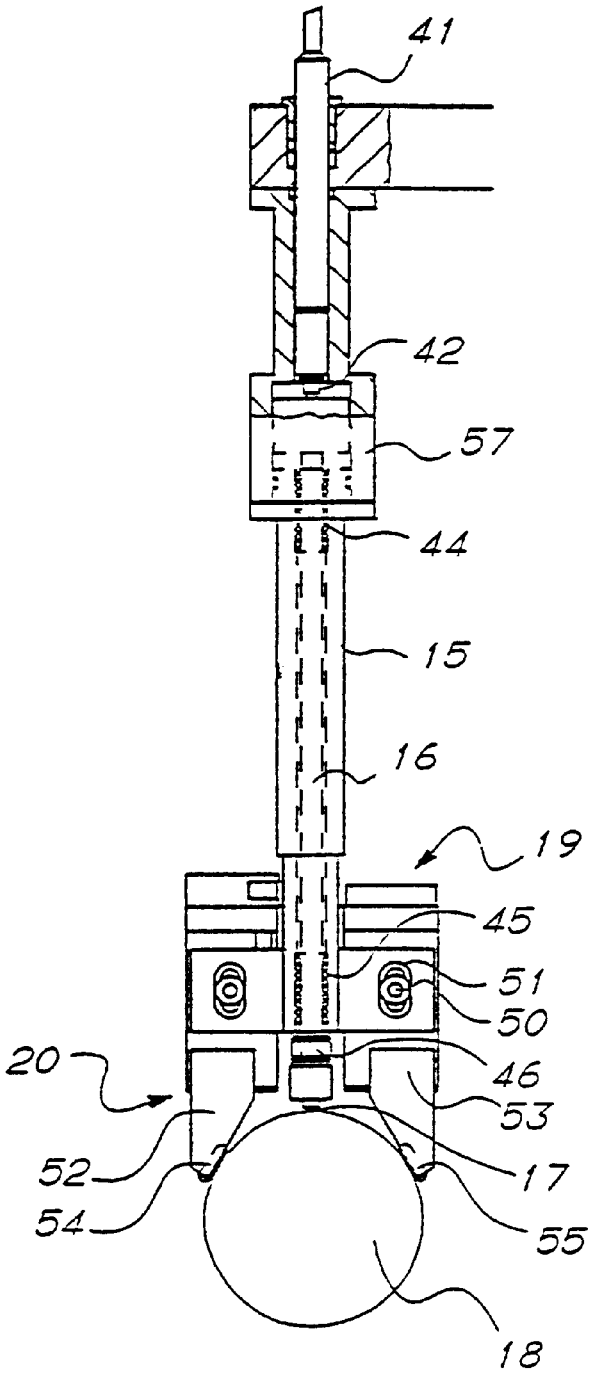
FIG. 7 is a partially cross-sectional view of the measuring system of the apparatus.

FIGS. 6 and 7 show some details of the measuring device of the apparatus. In FIG. 6 there is shown a crankpin 18 featuring in the central part, as usual, a lubrication hole 38. In order to avoid any interferences with the lubrication hole 38, feeler 17 is offset with respect to the intermediate cross-section of pin 18, by means of a transversal portion 40 of the transmission rod 16.

The axial displacements of the transmission rod 16 with respect to a reference position are detected by means of a measurement transducer, fixed to the tubular casing 15, for example a "cartridge" head 41 with a feeler 42 contacting an abutting surface formed in a second transversal portion 43 of the transmission rod 16. In this way, feeler 17 and measuring head 41 along with feeler 42 fare kept aligned along a measurement axis. As shown in FIG. 7, too, the axial displacement of the transmission rod 16 is guided by two bushings 44 and 45, arranged between casing 15 and rod 16. A metal bellows 46, that is stiff with respect to torsional forces, and has its ends fixed to rod 16 and to casing 15, respectively, accomplishes the dual function of preventing rod 16 from rotating with respect to casing 15 (thus preventing feeler 17 from undertaking improper positions) and sealing the lower end of casing 15, whereto the coolant delivered by the nozzle of tube 35, is directed.

The support block 19 is secured to the guide casing 15 by means of screws 50 passing through slots 51 and supports the reference device 20, consisting of two elements 52, 53 with sloping surfaces, whereto there are secured two bars 54, 55. In the area 57, the guide tubular casing 15 is secured to the free end of the coupling element 12, for example, as hereinbefore mentioned, by means of a tie coupling 13, not shown in FIG. 7. The tie coupling 13 enables rough axial adjustments, in the direction of the bisecting line of the Vee defined by bars 54, 55, in order to ensure that the two bars 54, 55 and feeler 17 contact crankpin 18. The rest position of feeler 17 can be adjusted by means of screws 50 and slots 51.

A reference device 20 and the associated guide device 21, not shown in FIG. 7, cover a predetermined measuring range. In order to change the measuring range, support block 19 is replaced with another block 19 carrying the appropriate reference device 20 and guide device 21.

There is also foreseen, as schematically shown in FIG. 5, a proximity sensor 60 adapted for detecting the presence of the crankshaft 34 in the machining position. Sensor 60 is connected to the computer numerical control 61 of the grinding machine. When there is no signal monitoring the presence of a workpiece, the numerical control 61 prevents the retraction of rod 29 of cylinder 28 and thus the checking apparatus cannot displace from the rest position. There are other proximity sensors 62 and 63, shown in FIGS. 2 and 4, also connected to the computer numerical control 61, for detecting, depending on the position of cap 30, the rest position (FIG. 4) and the measuring condition (FIG. 2) of the apparatus, respectively.

Figure 8:
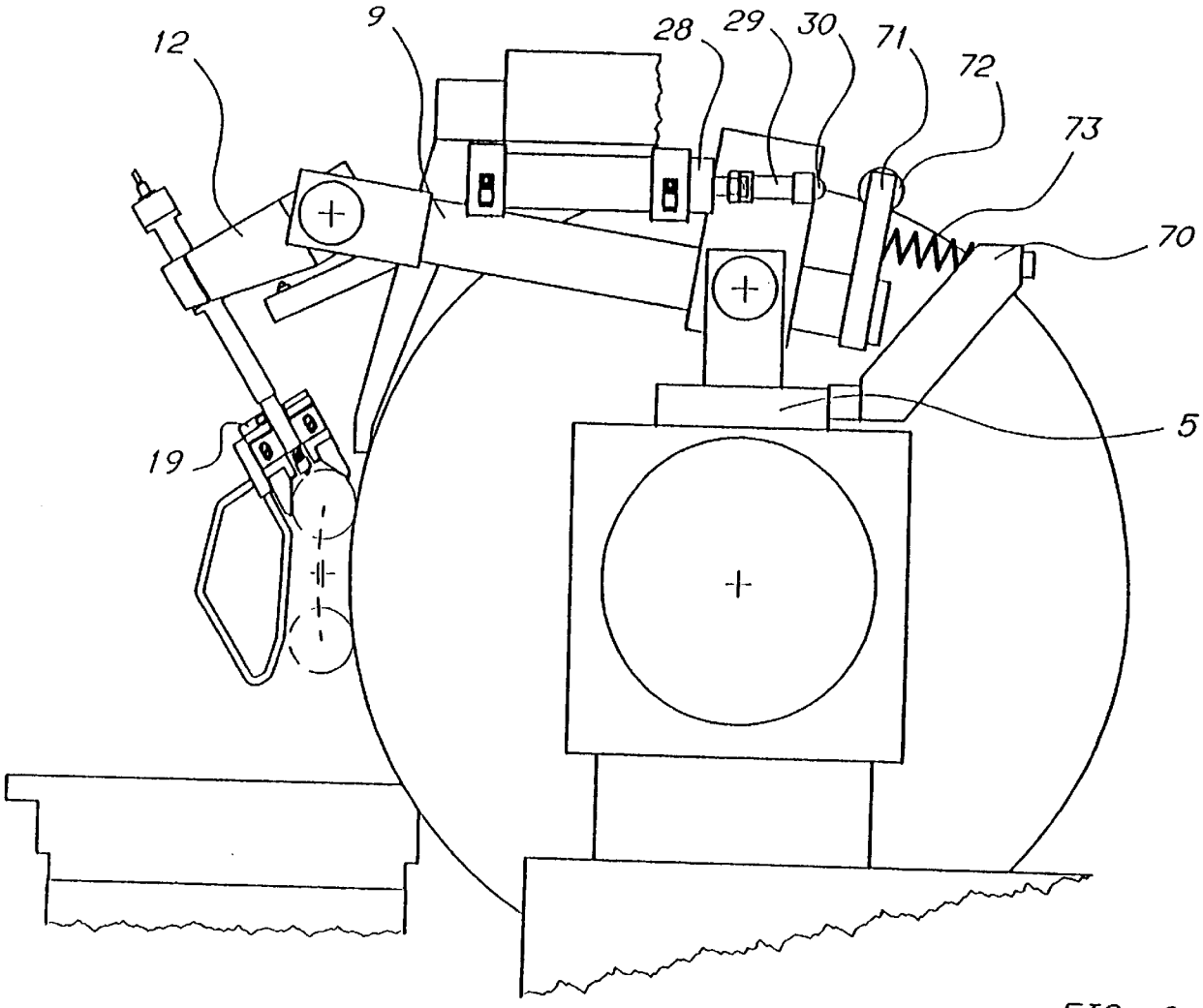
FIG. 8 is a lateral view of a measuring apparatus including some modifications with respect to the apparatus of FIGS. 1 to 5, in the same position shown in FIG. 1.

FIG. 8 shows a checking apparatus that, apart from the counterweight 27, includes all the features that have been described with reference to FIGS. 1 to 7.

Additionally, the apparatus of FIG. 8 includes an overhang 70, rigidly fixed to the support element 5, an arm 71, connected at one end to element 9, an abutment with an idle wheel 72 coupled to the free end of arm 71, and a coil return spring 73 joined to the overhang 70 and the arm 71. In this case, when cylinder 28 is activated for displacing the piston and the rod 29 towards the right (with reference to the figure), cap 30 pushes against the idle wheel 72 to displace the checking apparatus to a rest position (substantially corresponding to the one shown in FIG. 4). The spring 73, that, owing to its connections, is substantially arranged between the support element 5 and the first coupling element 9, has a statical counterbalancing effect, similar to the one of the counterweight 27 of FIGS. 1–5, allowing to establish a proper engagement force between the Vee reference device 20 and the crankpin 18 to be checked.

When, in order to permit displacement of the apparatus to the checking condition, rod 29 is retracted, and cap 30 disengages from the abutment, or idle wheel 72, support block 19 approaches the crankpin 18 through rotation of the coupling elements 9, 12, and the apparatus operates as described hereinabove with reference to FIGS. 1 to 5. The cooperation between crankpin 18 and reference device 20 is maintained, as above described, owing to the displacements of the components caused by the force of gravity.

The action of the coil spring 73, the stretching of which increases with the lowering of the support block 19, partially and dynamically counterbalances the forces due to the inertia of the moving parts of the checking apparatus following the displacements of the crankpin 18.

In such a way, it is possible, for example, to avoid over stresses between the reference device 20 and the crankpin 18, in correspondence of the lower position 18", that might tend to move apart the sides of the Vee of the reference device 20. On the other side, since during the raising movement of the apparatus (due to rotation of the crankpin towards the upper position 18') the pulling action of the spring 73 decreases, the inertial forces tending, in correspondence of the upper position 18', to release the engagement between the Vee reference device 20 and the crankpin 18, can be properly counterbalanced. In the latter case, it is pointed out that the counterbalancing action is obtained, by means of the spring 73, through a decreasing of its pulling action. In other words, the coil spring 73 does not cause any pressure between the reference device 20 and the crankpin 18, that mutually cooperate, as above mentioned, just owing to the force of gravity.

It is possible to equip one of the above described checking apparatuses with further feelers, associated transmission rods and measurement transducers for detecting further diameters and other dimensions and/or geometrical or shape characteristics of the crankpin being machined. The Vee-shaped reference device 20 can be replaced with reference devices of a different type.

It is also possible to arrange the axis of rotation 7 in a different position with respect to what is above described and shown in the drawing figures, i.e. on a different vertical plane and in a different vertical position.

It is obvious that in a multi wheel grinding machine simultaneously machining a plurality of crankpins there can be foreseen just as many checking apparatuses.

What is claimed is:

1. Apparatus for checking the diameter of crankpins rotating with an orbital motion about a geometrical axis, in the course of the machining in a numerical control grinding machine including a worktable, defining said geometrical axis, and a grinding-wheel slide, movable in a transversal direction, with a reference device for cooperating with the crankpin to be checked and defining a checking condition of the apparatus, a measuring device movable with the reference device, a support device for supporting the reference device and the measuring device, the support device having a support element fixed to the grinding-wheel slide, a first coupling element coupled to the support element so as to rotate about a first axis of rotation parallel to said geometrical axis, and a second coupling element carrying the reference device and coupled to the first coupling element in such a way as to rotate with respect to it about a second axis of rotation parallel to said geometrical axis, a guide device associated with the reference device for guiding the arrangement of the reference device on the crankpin in the course of said orbital motion, and a control device for enabling the apparatus to displace in an automatic way from a rest position to the checking condition, and vice versa, the guide device having a guiding surface adapted to cooperate with the crankpin and guide the engagement of the reference device on the crankpin to be checked in the course of the displacement towards said checking condition.

2. An apparatus according to claim 1, wherein, in said rest position, the reference device is arranged substantially above said geometrical axis and, in the displacement from the rest position to the checking condition, describes a trajectory with a prevailing vertical component.

3. An apparatus according to claim 1, wherein said first axis of rotation of the first coupling element substantially lies in a vertical plane wherein the axis of rotation of the grinding wheel lies.

4. An apparatus according to claim 3, wherein said first axis of rotation of the first coupling element lies above the axis of rotation of the grinding wheel and below the upper periphery of the grinding wheel.

5. An apparatus according to one of claims 1 to 4, wherein said guiding surface of the guide device is shaped for maintaining contact with the crankpin while the reference device displaces towards said rest position, for limiting the rotation of the first and of the second coupling elements about said first axis of rotation and second axis of rotation.

6. An apparatus according to claim 5, wherein said guide device is made by a bent metal rod.

7. An apparatus according to claim 1, wherein said reference device is substantially of a Vee-shaped type.

8. An apparatus according to claim 7, wherein said reference device is adjustable with respect to the second coupling element in the direction of the bisecting line of said Vee.

9. An apparatus according to claim 5, wherein said reference device and guide device can be replaced in order to allow variations of the measurement range of the diameters of the crankpins.

10. An apparatus according to claim 1, comprising a counterweight coupled to said first coupling element, the reference device being adapted for maintaining contact with the crankpin to be checked, substantially owing to the forces of gravity.

11. An apparatus according to claim 1, comprising a spring arranged between said support element and said first coupling element, the reference device being adapted for maintaining contact with the crankpin to be checked, substantially owing to the forces of gravity.

12. An apparatus according to claim 11, wherein said spring is arranged between said support element and said first coupling element to apply to the reference device a pulling action tending to release said contact with the crankpin to be checked.

13. An apparatus according to claim 12, wherein said spring is a return spring.

14. An apparatus according to one of claims 10 to 13, comprising an abutment connected to the first coupling element, wherein said control device comprises a movable element for cooperating with said abutment for bringing and keeping the apparatus in the rest position.

15. An apparatus according to claim 14, wherein sold control device comprises a double-acting cylinder.

16. An apparatus according to claim 1, comprising a detecting device for detecting the presence of the workplace to be checked in the checking position, the control device being controlled by the detecting device for preventing, in the absence of a workpiece, the displacement of the apparatus from the rest position.

17. An apparatus according to claim 8, wherein in said rest position the bisecting line of said Vee is substantially arranged in a vertical position.

18. An apparatus according to claim 1, wherein the coupling between the second coupling element and the first coupling element comprises a limiting element for limiting the rotational displacements of the second coupling element with respect to the first coupling element.

19. An apparatus according to claim 1, wherein at least one of said first and second coupling elements comprises substantially linear offset portions, for avoiding interference with elements of the grinding machine.

20. An apparatus according to claim 1, wherein said measuring device comprises a guide casing fixed to the second coupling element, a transmission rod axially movable within the guide casing, a feeler eccentrically fixed to an and of said transmission rod for contacting the crankpin, a measurement transducer fixed to the guide casing and provided with a movable element cooperating with the other end of the transmission rod, and a device for preventing rotational displacements of the transmission rod with respect to the guide casing.

21. An apparatus according to claim 20, wherein said device for preventing rotational displacements of the transmission rod with respect to the guide casing comprises a metal bellows having its ends fixed to the transmission rod and to the guide casing, respectively.

22. An apparatus according to claim 20, comprising two bushings arranged between the guide casing and the transmission rod, for centering and guiding the transmission rod with respect to the guide casing.

23. An apparatus according to claim 20, wherein said reference device is fixed in a dismantable way to said guide casing.

24. An apparatus according to one of the claims 20 to 23, wherein said second coupling element comprises said guide casing and an arm, substantially perpendicular to the guide casing, coupled in a rotating way to the first coupling element.

25. Apparatus for checking the diameter of crankpins rotating with an orbital motion about a geometrical axis, in the course of the machining in a numerical control grinding machine including a worktable, defining said geometrical axis, and a grinding-wheel slide, movable in a transversal direction, with a Vee-shaped reference device for cooperating with the crankpin to be checked, a measuring device movable with the reference device, a guide device for guiding the arrangement of the reference device on the crankpin in the course of said orbital motion, a support element fixed to the grinding-wheel slide, a first coupling element, coupled in a movable way to the support element, a second coupling element carrying the reference device and coupled, in a movable way, to the first coupling element, and a control device for enabling the apparatus to displace in an automatic way from a rest position to a checking condition, and vice versa, the guide device having a guiding surface adapted to guide the engagement of the reference device on the crankpin to be checked in the course of the displacement towards said checking condition.

26. An apparatus according to claim 25, wherein the first coupling element is coupled to the support element so as to rotate about an axis of rotation parallel to said geometrical axis.

27. An apparatus according to claim 25, wherein the second coupling element is coupled to the first coupling element in such a way as to rotate with respect to it about an axis of rotation parallel to said geometrical axis.

28. An apparatus according to claim 25, comprising a spring arranged between said support element and said first coupling element to apply to the reference device a pulling action tending to release said contact with the crankpin to be checked, the reference device being adapted for maintaining contact with the crankpin to be checked substantially owing to the forces of gravity.

29. An apparatus according to claim 25, wherein said measuring device comprises a transmission rod axially movable with respect to the Vee-shaped reference device substantially along the direction of the bisecting line of said Vee, a feeler fixed to an end of said transmission rod for contacting the crankpin, a measurement transducer fixed with respect to the Vee-shaped reference device and provided with a movable element cooperating with the other end of the transmission rod.

30. Apparatus for checking the diameter of crankpins rotating with an orbital motion about a geometrical axis, in the course of the machining in a numerical control grinding machine including a worktable, defining said geometrical axis, and a grinding-wheel slide, movable in a transversal direction, with a reference device for cooperating with the crankpin to be checked, a measuring device movable with the reference device, a support device, fixed to the grinding-wheel slide, and including mutually movable coupling elements for movably supporting the reference device and the measuring devices and a counterbalancing spring connected to the grinding-wheel slide and to one of the coupling elements to apply to the reference device a pulling action tending to release said contact with the crankpin to be checked, the reference device being adapted for maintaining contact with the crankpin to be checked substantially owing to the forces of gravity.

31. A method for checking the diameter of crankpins rotating with an orbital motion about a geometrical axis, in the course of the machining in a numerical control grinding machine with a worktable and a grinding-wheel slide, by means of a checking apparatus including a support device fixed to the grinding-wheel slide and movably carrying an assembly including a reference device, for cooperating with the crankpin to be checked, a measuring device and a guide device with a guide surface, wherein a movement of said assembly from a rest position to a checking condition is performed to bring the reference device into contact with the crankpin while said crankpin orbitally moves, said guiding surface touching the crankpin and guiding the engagement of the reference device on the crankpin while said crankpin orbitally moves.

32. A method according to claim 31, wherein said movement of the assembly is caused by the force of gravity.

33. A method according to claim 32, wherein further movements of the assembly are caused by the orbital motion of the crankpin and by the force of gravity to maintain said engagement of the reference device an the crankpin.

34. A method according to claim 33, wherein said movement and further movements of the assembly describe a trajectory with a mainly vertical component.

35. A method according to claim 34, wherein a spring, connected to the grinding-wheel slide and to a movable portion of the support device, partially and dynamically counterbalances the forces due to the inertia of the moving parts of the checking apparatus during the orbital motion of the crankpin.

36. A method according to one of claims 31 to 35, in a grinding machine where an upper position of the orbitally moving crankpin is defined, wherein said movement of the assembly from the rest position is controlled to stop the assembly in correspondence of a position close to said upper position of the crankpin, and to move again the assembly towards the checking condition when the crankpin is close to said upper position.

* * * * *

UNITED STATES PATENT AND TRADEMARK OFFICE

CERTIFICATE OF CORRECTION

PATENT NO. : 6,067,721

DATED : May 30, 2000

INVENTOR(S) : Dall'Aglio et al.

It is certified that error appears in the above-identified patent and that said Letters Patent is hereby corrected as shown below:

Column 6, line 41, after "feeler 42" delete "fare", substitute --are--.

In the Claims:

Claim 20, line 5, delete "and", substitute --end--.

Claim 31, line 9, delete "guide", substitute --guiding--.

Claim 33, line 4, delete "an", substitute --on--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*